US008701525B2

(12) United States Patent
Grover et al.

(10) Patent No.: US 8,701,525 B2
(45) Date of Patent: Apr. 22, 2014

(54) NUT DRIVER DRILL BIT

(76) Inventors: Neal Grover, Gilroy, CA (US); Ian Grover, Goleta, CA (US); John Horton, Santa Barbara, CA (US)

( * ) Notice: Subject to any disclaimer, the term of this patent is extended or adjusted under 35 U.S.C. 154(b) by 79 days.

(21) Appl. No.: 12/901,566

(22) Filed: Oct. 10, 2010

(65) Prior Publication Data

US 2011/0146460 A1 Jun. 23, 2011

Related U.S. Application Data

(60) Provisional application No. 61/284,560, filed on Dec. 22, 2009.

(51) Int. Cl.
*B25B 13/48* (2006.01)

(52) U.S. Cl.
USPC ..... 81/64

(58) Field of Classification Search
USPC ..... 81/64, 44; 15/3.53
See application file for complete search history.

(56) References Cited

U.S. PATENT DOCUMENTS

| | | | | | |
|---|---|---|---|---|---|
| 2,079,356 | A | * | 5/1937 | Lukowski | 15/3.53 |
| 2,390,226 | A | * | 12/1945 | Smith | 15/3.53 |
| 2,398,823 | A | * | 4/1946 | Fisher | 15/3.53 |
| 2,572,601 | A | | 10/1951 | De Wilde | |
| 2,804,957 | A | * | 9/1957 | Pechin, Jr. | 192/107 R |
| 2,816,535 | A | | 12/1957 | Sells | |
| 4,485,701 | A | * | 12/1984 | Hough | 81/64 |
| 4,531,482 | A | | 7/1985 | Scheckel | |
| 4,615,311 | A | | 10/1986 | Scheckel | |
| 5,490,438 | A | * | 2/1996 | Zupo et al. | 81/53.11 |
| 5,615,587 | A | * | 4/1997 | Foerster, Jr. | 81/64 |
| 6,083,345 | A | * | 7/2000 | Frank | 156/761 |
| 6,136,143 | A | * | 10/2000 | Winter et al. | 156/761 |
| 6,220,122 | B1 | * | 4/2001 | Forsell et al. | 81/44 |
| 6,354,176 | B1 | * | 3/2002 | Nordlin | 81/124.4 |
| D486,044 | S | * | 2/2004 | Trejo | D8/14 |
| 7,263,917 | B1 | | 9/2007 | Benysh | |
| D552,442 | S | * | 10/2007 | Hutchings | D8/29 |
| 7,430,944 | B1 | | 10/2008 | Miller | |
| D624,381 | S | * | 9/2010 | Waller | D8/70 |
| 2009/0288524 | A1 | | 11/2009 | Vasi | |

FOREIGN PATENT DOCUMENTS

JP 2007144574 A * 6/2007

* cited by examiner

*Primary Examiner* — David B Thomas
(74) *Attorney, Agent, or Firm* — Lyman H. Smith

(57) ABSTRACT

A nut driver bit is designed to install nuts onto threaded shafts, such as all-thread rods and bolts. The nut driver bit may be driven by a power drill which causes a driver end of the nut driver bit to rotate. The driver end may contact a nut, thereby causing the nut to rotate. The driver end may be covered in with a contact grip for gripping the nut during use. A worker may install and spin a nut on a threaded shaft without requiring their fingers to manually rotate the nut. The nut driver bit may drastically reduce the time required to install nuts onto threaded rods.

13 Claims, 3 Drawing Sheets

NUT DRIVER DRILL BIT

BACKGROUND OF THE INVENTION

The present invention relates to hand and power tools and, more particularly, to a drill driver bit that is adapted to turn nuts onto a threaded shaft, such as a threaded rod.

Typically, nuts are spun onto threads by hand, usually with one's fingers. The main problem with conventional nut installation is that the process is very inefficient, requiring substantial time to install and turn the nut by hand. Often, a worker is placed in an awkward, difficult and poor ergonomic position to install and turn a nut on a threaded shaft. Another problem with conventional nut installation is that the uncomfortable and repetitive motion of the worker's hands may cause injury to the worker over time.

As can be seen, there is a need for a tool to reduce the time and work involved in installing and turning a nut on a threaded shaft.

SUMMARY OF THE INVENTION

In one aspect of the present invention, a tool comprises a post adapted to mount into a drill on a first end thereof; a driver end having an outer layer of material attached to a second end of the post, wherein the outer layer is formed of a material capable of rotating a nut on a threaded shaft when the outer later is rotated while contacting the nut.

In another aspect of the present invention, a nut driver bit comprises a post adapted to mount into a drill on a first end thereof; a substrate disposed on a second end of the post; and an outer layer of material attached to the substrate, wherein the outer layer is formed of a material capable of rotating a nut on a threaded shaft when the outer later is rotated while contacting the nut.

In a further aspect of the present invention, a method for turning a nut on a threaded shaft comprises rotating a driver end of a nut driver bit; and contacting an outer layer of the driver end with the nut.

These and other features, aspects and advantages of the present invention will become better understood with reference to the following drawings, description and claims.

DETAILED DESCRIPTION OF THE INVENTION

Figure 1:
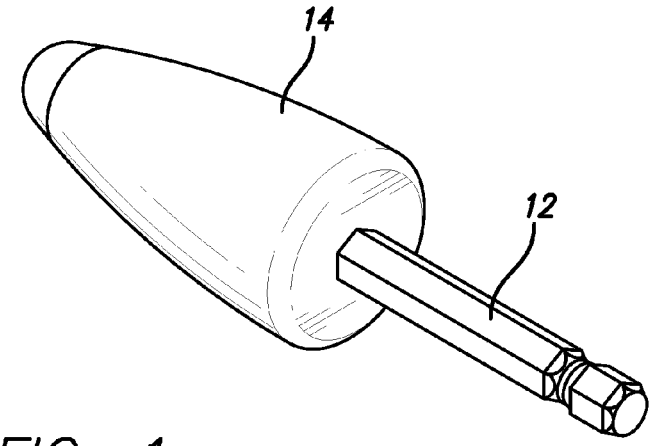
FIG. 1 is a an perspective view of a nut driver tool according to one embodiment of the present invention.
Figure 2:
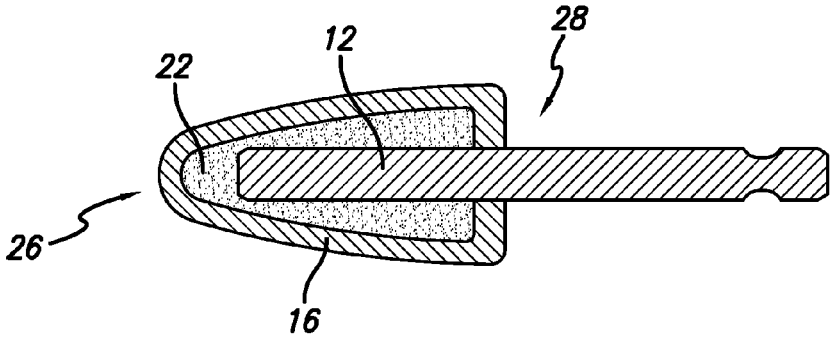
FIG. 2 is a cross sectional view of the nut driver tool of FIG. 1.
Figure 3:
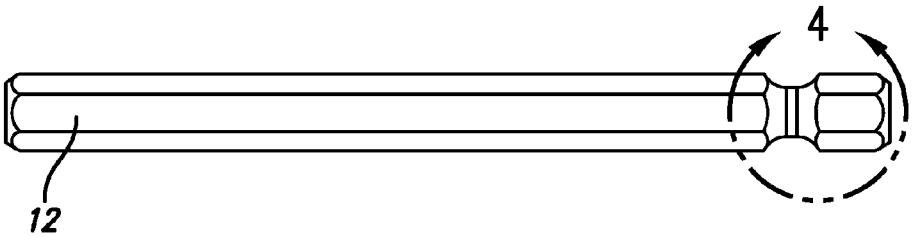
FIG. 3 is a perspective view of the shaft of the nut driver tool of FIG. 1.
Figure 4:
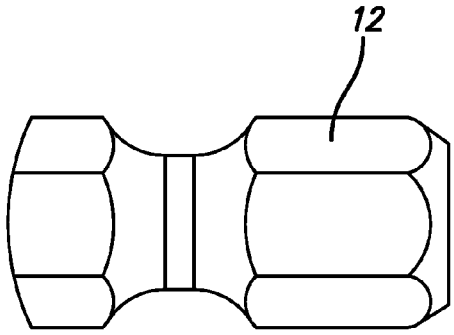
FIG. 4 is a close up view of inset "B" of FIG. 3.
Figure 5:
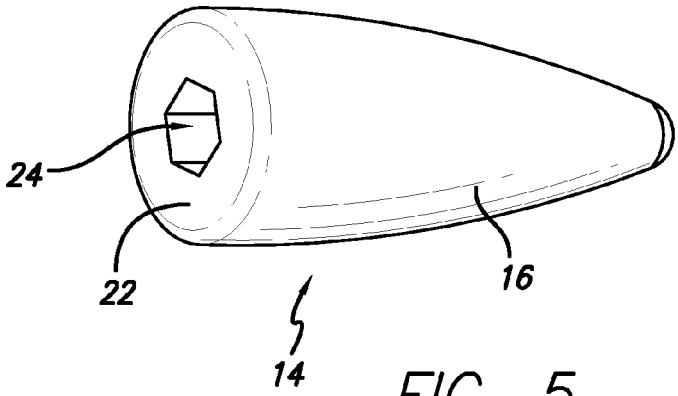
FIG. 5 is a perspective view of the driver end of the nut driver tool of FIG. 1.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, an embodiment of the present invention provides a nut driver bit designed to install nuts onto threaded shafts, such as all-thread rods and bolts. The nut driver bit may be driven by a power drill which causes a driver end of the nut driver bit to rotate. The driver end may contact a nut, thereby causing the nut to rotate. The driver end may be covered in with a contact grip for gripping the nut during use. A worker may install and spin a nut on a threaded shaft without requiring their fingers to manually rotate the nut. The nut driver bit may drastically reduce the time required to install nuts onto threaded rods.

Referring to FIGS. 1 through 5, a nut driver bit 10 may include a post 12 and a driver end 14. The post 12 may be made of a material strong and rigid enough to allow a drill (not shown) to turn the driver end via the post 12. Typically the post 12 is made of steel. In some embodiments, the post 12 may be hardened steel. In spark-free environments, the post 12 may be made of, for example, an aluminum bronze alloy. The post 12 may have a length suitable for allowing the post 12 to fit into a drill on one end and to attach to the driver end 14 on the other end. In some embodiments, the post 12 may extend from the driver end 14 between about 30 and about 60 mm. The post 12 may have a cross-sectional shape that may fit into a drill chuck (not shown). In some embodiments, the cross-sectional shape of the post 12 may be hexagonal. In some embodiments, the post 12 may comply with certain standards, such as DIN 3126 ISO 1173 Style C 6.3, which may permit the post 12 to fit into many conventional impact drills. The post 12 may have, for example, a ¼ inch hexagonal cross-section. The post 12 may be engraved with product and/or company information, promotional material, advertising material or the like.

The driver end 14 may have an outer layer 16 adapted to grip a nut 18 (see FIG. 8), wherein rotation of the outer layer 16 may cause the nut 18 to rotate on a threaded rod 20. The outer layer 16 may be a resilient material formed from, for example, rubber, such as neoprene, silicone, or the like. The outer layer 16 may have a hardness from about 10 to about 30 durometer, typically from about 15 to about 25 durometer.

A substrate 22 may be disposed between the outer layer 16 and the post 12. In some embodiments, the substrate 22 may be made of nylon, foam, acrylonitrile butadiene styrene (ABS), or the like. The post 12 may fit into a centrally disposed hole 24 in the substrate 22. In some embodiments, the substrate 22 may be molded onto the post 12, where the post 12 may adhere to the substrate 22 during the molding process. In some embodiments, the post 12 may be fixed to the substrate 22 with an adhesive. In other embodiments, the post 12 may be removably attached to the substrate 22, such as by a friction fit, or with a ball and socket configuration (as used in conventional ratchets and sockets, for example). The removable attachment of the post 12 with the substrate 22 may permit replacement of the driver head 12, either when the driver head 12 is worn, or to change the size or shape of the driver head, as described below with reference to FIGS. 6A through 6C.

The nut driver tool 10 may be about 3.5 inches long, with the driver head 14 being from about ¼ to about ¾ of the entire length of the nut driver tool 10.

A tip 26 of the driver head 14 may be rounded and the diameter of the driver head 14 may increase from the tip 26 towards a post end 28 of the driver head 14. This shape may allow turning of the nut 18 regardless of the angle of contact between the driver head 14 and the nut 18. The rounded tip 26 may allow a worker to install the nut 18 completely threaded or nearly completely threaded on the threaded rod 20. Therefore, little or no manual threading of the nut 18 on the threaded rod 20 may be required.

Figure 6A:
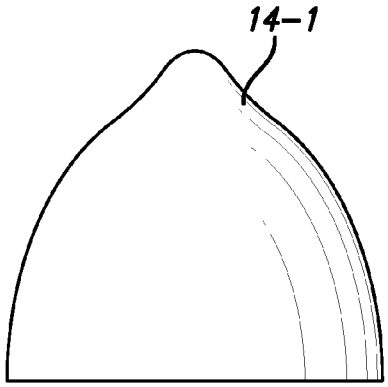
FIGS. 6A through 6C show alternate configurations of the driver end of the nut driver of the present invention.
Figure 6B:
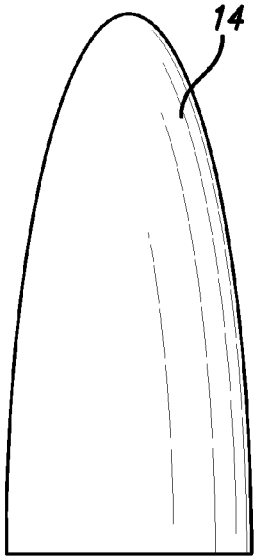
Figure 6C:
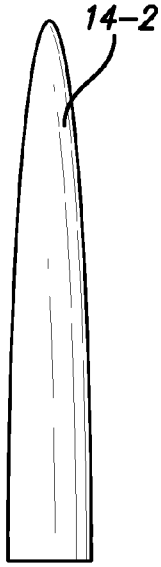

As shown in FIGS. 6A through 6C, various shaped driver heads 14 may be used for turning the nut 18. A wide driver head 14-1 may be used in close fitting situations or for larger nuts. A needle driver head 14-2 may be used to reach nuts where there is minimal clearance between the nut and its surrounding.

Figure 7:
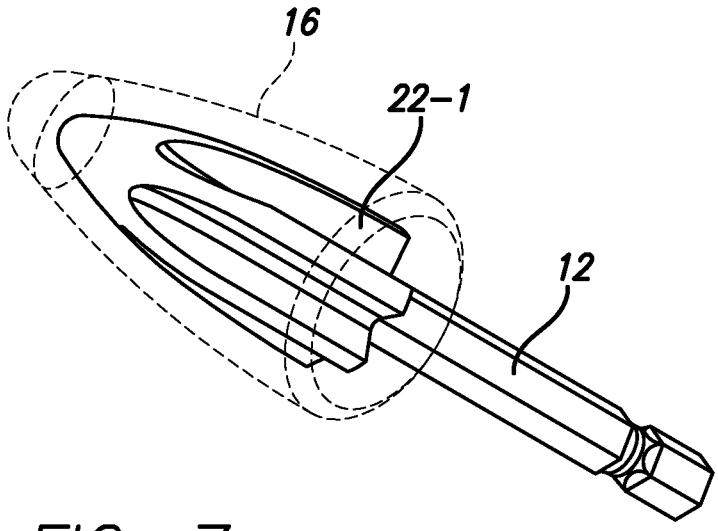
FIG. 7 is an isometric view of a nut driver tool according to an alternate embodiment of the present invention.

Referring to FIG. 7, in an alternate embodiment of the present invention, a nut driver bit 10-1 may include a substrate 22-1 that has ridges, as opposed to a smooth substrate, as described above. The ridges may help the substrate 22-1 grip onto the outer layer 16. In another alternative embodiment, the substrate 22, 22-1 may be removed, wherein the outer layer 16 may be directly attached to the post 12.

Figure 8:
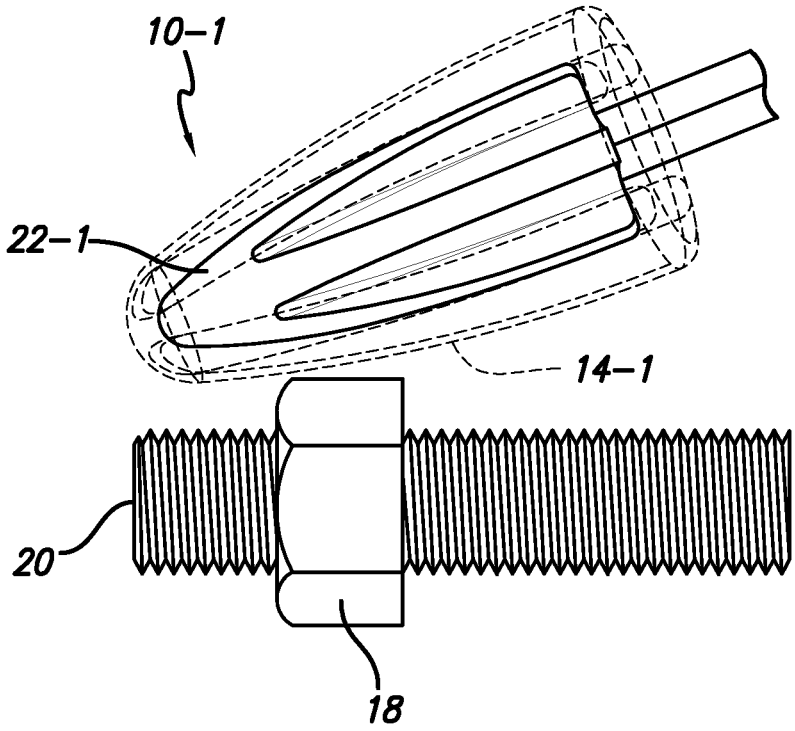
FIG. 8 is a perspective view showing the nut driver tool of FIG. 6 in use.

Referring to FIG. 8, to use the nut driver bit 10-1, a worker may rotate the bit 10-1 with a drill (not shown), such as an impact drill. The rotating driver head 14-1 may contact the nut 18, rotating the nut 18 on the threaded rod 20. By keeping constant contact between the nut 18 and the driver head 14-1, the nut 18 can be turned on the threaded rod 20. The worker can increase or decrease the speed of the drill, and thus, increase or decrease the speed of the nut's rotation. The angle of contact between the driver head 14-1 and the nut 18 may be varied while still achieving rotation of the nut 18. The nut driver tool 10, 10-1 may be used to turn various size nuts, from small nuts (e.g., #6, #8, and the like) to larger nuts (e.g., ½", ¾" and the like).

It should be understood, of course, that the foregoing relates to exemplary embodiments of the invention and that modifications may be made without departing from the spirit and scope of the invention as set forth in the following claims.

We claim:

1. A tool comprising:

a post adapted to mount into a drill on a first end thereof;

a conical-shaped substrate covering a second, opposite end of the post; and an outer layer of material, having a conical-shaped exterior surface, covering the substrate, wherein the outer layer is formed of a material capable of rotating a nut on a threaded shaft when the outer later is rotated while contacting the nut.

2. The tool of claim 1, wherein the second end of the post is disposed in a central hole in the substrate.

3. The tool of claim 1, wherein the substrate is formed of nylon.

4. The tool of claim 1, wherein the post is adapted to mount into an impact drill.

5. The tool of claim 1, wherein the post has a ¼ inch hexagonal cross-section.

6. The tool of claim 1, wherein the outer layer is made of rubber.

7. The tool of claim 1, wherein the diameter increases from the tip to the post end of the driver end.

8. A nut driver bit comprising:

a post adapted to mount into a drill on a first end thereof;

ridges disposed on a second end of the post;

a substrate disposed over the ridges and covering the second end of the post; and an outer layer of material, having a conical-shaped exterior surface, attached to the substrate, wherein the outer layer is formed of a material capable of rotating a nut on a threaded shaft when the outer later is rotated while contacting the nut.

9. The nut driver bit of claim 8, wherein the substrate is formed of nylon.

10. The nut driver bit of claim 8, wherein the post is adapted to mount into an impact drill.

11. The nut driver bit of claim 8, wherein the outer layer is made of rubber.

12. A method for turning a nut on a threaded shaft, the method comprising:

rotating a driver end of a nut driver bit; and contacting an outer layer of the driver end with the nut, wherein the nut driver bit includes a substrate covering a driven end of the nut driver bit, the driven end having ridges formed thereupon for receiving the substrate; and the outer layer, having a conical-shaped exterior surface, is disposed over the substrate.

13. The method of claim 12, further comprising inserting one end of the post of the nut driver bit into a drill.

* * * * *